US006059335A

United States Patent [19]

Matson

[11] Patent Number: 6,059,335

[45] Date of Patent: May 9, 2000

[54] WIRE ROPE SLING PROTECTIVE AND CONTAMINATION CONTAINMENT COVERS

[75] Inventor: Erik F. Matson, Lakewood, Calif.

[73] Assignee: TRW Inc., Redondo Beach, Calif.

[21] Appl. No.: 09/182,126

[22] Filed: Oct. 29, 1998

[51] Int. Cl.[7] ..... B66C 1/12

[52] U.S. Cl. ..... 294/74

[58] Field of Search ..... 294/74–77; 57/210, 57/224, 230–233, 3

[56] References Cited

U.S. PATENT DOCUMENTS

| | | | |
|---|---|---|---|
| 3,310,333 | 3/1967 | Hutson | 294/74 |
| 4,124,244 | 11/1978 | Bryant | 294/74 |
| 4,210,089 | 7/1980 | Lindahl | 294/74 |
| 4,421,352 | 12/1983 | Raue et al. | 294/74 |
| 5,492,383 | 2/1996 | Kentner, Sr. | 294/74 |

OTHER PUBLICATIONS

The Zippertubing Co. Catalog, Catalog 9796–3/98, 1996.

*Primary Examiner*—Dean J. Kramer
*Attorney, Agent, or Firm*—Michael S. Yatsko

[57] ABSTRACT

A rugged and durable cover (22) for a wire rope sling (10) that encloses the length of the sling (10) and prevents particulates from being scraped from a soft nylon coating (20) of the sling (10) and enter the clean room environment of a spacecraft assembly high bay. The cover (22) is readily removable to allow the sling (10) to be visually inspected, such as is necessary during a proof load test. The cover (22) is secured to the sling (10) by a zipper type connection (48) running the length of the cover (22), and is connected to the sling (10) at both ends by straps (24), such as tie wraps. In a particular embodiment, the cover (22) is Zippertubing made of a VNH material and including a Z-track connection.

17 Claims, 2 Drawing Sheets

WIRE ROPE SLING PROTECTIVE AND CONTAMINATION CONTAINMENT COVERS

GOVERNMENT LICENSE

The U.S. Government may have a paid-up license in this invention and the right in limited circumstances to require the patent owner to license others on reasonable terms as provided for by the terms of Contract No. 8482.

BACKGROUND OF THE INVENTION

1. Field of the Invention

This invention relates generally to a protective covering for a cable and, more particularly, to a removable protective covering for a wire rope sling having intertwined steel strands coated with a nylon coating that is used in the aerospace industry to lift spacecraft components when assembling the spacecraft in a high bay.

2. Discussion of the Related Art

Satellites, spacecraft, space vehicles and the like are typically constructed and assembled in a high bay. The high bay is maintained in a clean room environment so that particulates and other matter do not contaminate highly sensitive spacecraft components, for example, optical equipment, such as star trackers and the like. Because the satellite itself, and many components and parts of the satellite, such as deployment fixtures, are large in size and are heavy, sometimes on the order of several thousand pounds, strong cables and cable connections are required to lift, move and place these components for assembly. Because the satellite and its components typically cost millions of dollars, high integrity and reliable cables are required for this purpose.

Wire rope slings are currently being used in the industry to move the satellite and satellite components within the high bay. A typical wire rope sling is a cable that includes a plurality of intertwined steel strands wound in a predetermined configuration for different designs, and covered with a soft nylon coating that protects the wire strands from moisture and contamination, to prevent rust and the like, so as to preserve the integrity of the sling. The nylon coating is formed to the sling in such a manner that it is part of the sling and cannot be removed. Different sized slings having different lifting tolerances are available and include, for example, one-quarter, one-half and one inch diameter slings that are about 30 ft. long.

A problem exists with the current use of these types of wire rope slings that affects the clean room environment. When the sling is handled and stored during its normal use to move and assemble the satellite components, the soft nylon coating often becomes scraped and damaged, and nylon particles flake off of the sling causing contamination in the clean room. In other words, because the nylon coating of the wire sling is soft and is stored in a wound manner in a storage compartment, to be unwrapped and attached to connection hooks and the like in the clean room, the natural use and handling of the sling causes scrapes against the nylon coating that releases nylon particulate matter into the clean room environment. As the sling becomes older and more worn, the deterioration of the nylon coating increases. The sling is generally cleaned after use to reduce the nylon particulates. Because the slings are generally very heavy, 50–60 lbs., this problem is increased.

Currently, a new sling is purchased to replace a used sling that had a damaged nylon coating. However, because these types of wire rope slings can cost thousands of dollars, this cost is prohibitive. Other ways exist to prevent the nylon coating from being scraped and damaged, including wrapping the sling with a clean room approved tape. However, this solution also adds significant cost to the slings, and is not an effective solution. Further, proof load testing of the wire slings is performed on annual basis to monitor the integrity of the slings. Thus, any covering enclosing the nylon coating must be removed for visual inspection of the sling during the test.

What is needed is a sacrificial cover to protect the nylon coating of a wire rope sling to prevent contamination of a clean room environment from nylon particulates, where the cover is easily removable and is flexible to meet the storage requirements of the sling.

SUMMARY OF THE INVENTION

In accordance with the teachings of the present invention, a rugged cover for a wire rope sling used in the assembly of spacecraft components is disclosed that encloses the length of the sling, and prevents nylon particulates from being scraped from the soft nylon coating of the sling and enter the clean room environment of the spacecraft assembly high bay. The covering is readily removable to allow the sling to be visually inspected, such as is necessary during a proof load test. In one embodiment, the covering is secured to the sling by a zipper-type connection running the length of the cover, and is connected to the sling at both ends by straps, such as tie wraps. In a particular embodiment, the covering is Zippertubing made of a VNH material and includes a Z-track connection.

Additional objects, advantages, and features of the present invention will become apparent from the following description and appended claims, taken in conjunction with the accompanying drawings.

DETAILED DESCRIPTION OF THE PREFERRED EMBODIMENTS

The following description of the preferred embodiments directed to a cover for a wire rope sling is merely exemplary in nature, and is in no way intended to limit the invention or its applications or uses. For example, the cover for the wire rope sling of the invention is being described in connection with the aerospace industry to lift spacecraft components, but the cover may have other applications for cables and the like in other industries.

Figure 1:
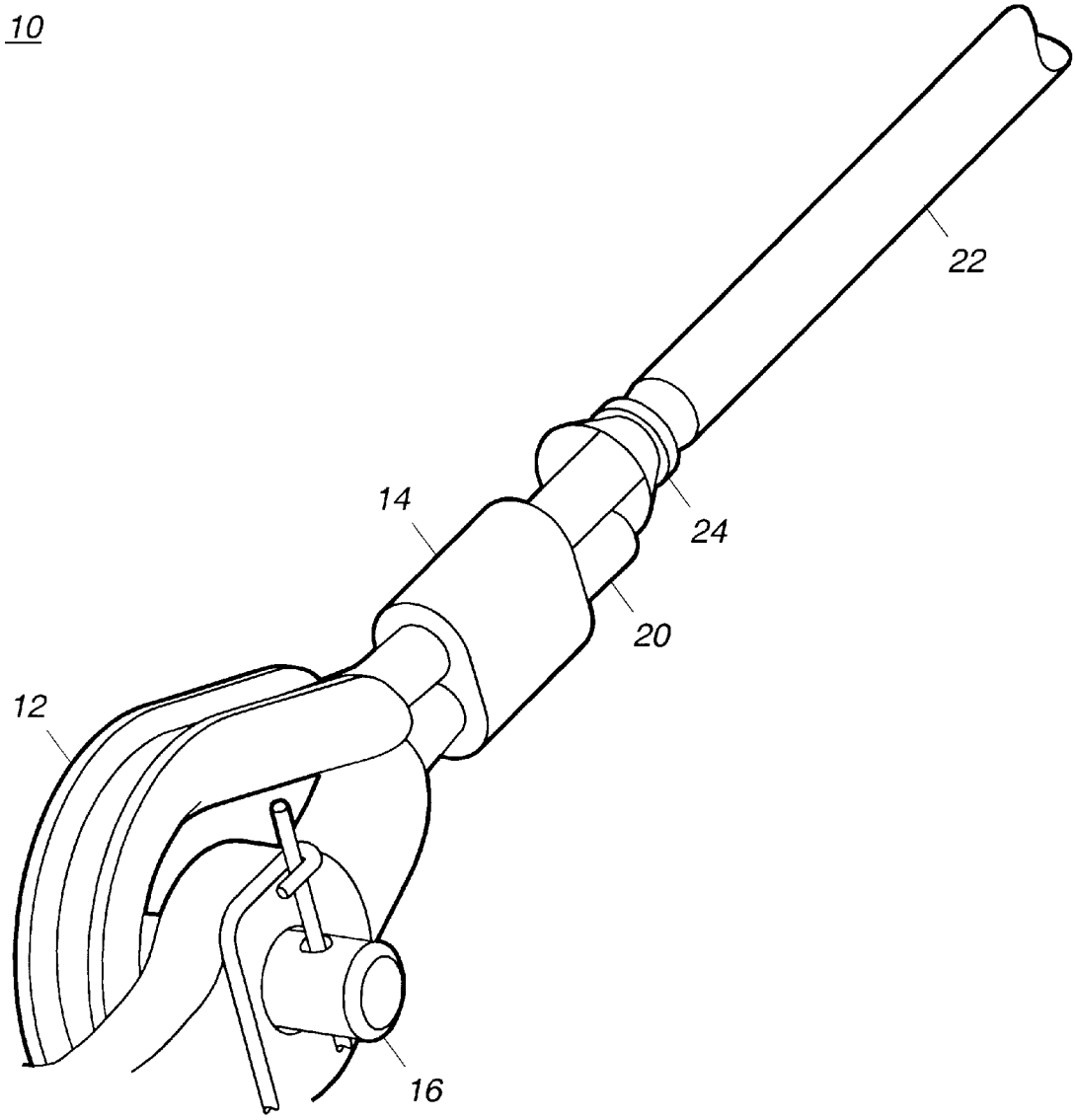
FIG. 1 is a perspective view of an end of a wire rope sling including a Zippertubing cover, according to an embodiment of the present invention.

FIG. 1 is perspective view of an end portion of a wire rope sling 10, according to the invention. The wire rope sling 10 is intended to be used to lift and move satellite components in a high bay during satellite assembly. This end of the wire rope sling 10 is wound around a steel thimble 12 such that the end of the sling 10 is wrapped back on itself, as shown. A crimp sleeve 14 is used to crimp the wrapped section of the wire rope 10 together, as shown, to hold it in place on the thimble 12. A turnbuckle 16 extends through the thimble 12, and is used to anchor the wire rope sling 10 at one end. The turnbuckle 16 can be connected to a spacecraft fixture (not shown) and an opposite end of the wire rope sling 10 will be connected to a mounting point in the high bay that allows the spacecraft component to be lifted and moved, as is well understood in the art. The thimble 12 and the turn buckle 16 are shown by way of a non-limiting example, in that any known connection can be used with the sling 10. Depending on the particular application, two to four wire rope sling legs are used to lift a particular spacecraft structure.

The wire rope sling 10 includes a plurality of intertwined steel strands (not shown) covered by an outer nylon coating 20 that is soft and flexible, and allows the sling 10 to be wound for storage and to be easily moved. In accordance with the teachings of the present invention, a cover 22 is placed over the outer nylon coating 20 of the sling 10 to prevent most of the length of the nylon coating 20 from being exposed to the clean room environment. The cover 22 extends from the crimp sleeve 14 all the way to an opposite end of the sling 10 to cover as much of the nylon coating 20 as possible. A tie wrap 24 secures the cover 22 to the sling 10 adjacent to the sleeve 14. Another tie wrap would be used at an opposite end of the cover 22. The cover 22 is made of a durable and highly flexible material that is hard and robust enough to handle the rigors of the satellite assembly during the handling of the sling 10 without becoming damaged and causing particulates to be removed from the cover 22. If the cover 22 does become damaged, then the cover 22 itself can be replaced without having to replace the entire sling 10, thus reducing costs.

Figure 2:
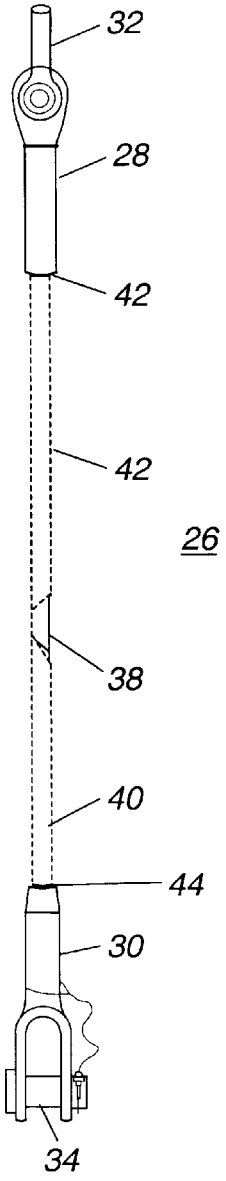
FIG. 2 is a cut-away elevation view of another wire rope sling including a Zippertubing cover, according to an embodiment of the present invention.

FIG. 2 shows an elevational view of another wire rope sling 26 that includes a closed socket swage 28 connected to one end of the sling 26 and an open socket swage 30 connected to an opposite end of the sling 26, known to those skilled in the art. The swages 28 and 30 are permanent connectors on the sling 26. A first turnbuckle 32 extends through the opening in the closed socket swage 28, and a second turnbuckle 34 extends through the opening in the open socket swage 30. Of course, the swages 28 and 30 are shown by way of example, in that any other type of connector suitable for the purposes described herein, such as eyes, hooks, shackles and other connectors, can be secured to the ends of the sling 26. The sling 26 includes a series of intertwined steel strands wound together in a predetermined configuration and covered by a soft nylon coating to produce an inner cable 38. An outer cover 40, according to the invention, is removably secured to the inner cable 38 and is positioned along the length of the sling 26 from the closed swage 28 to the open swage 30, as shown. A first tie wrap 42 secures the cover 40 to the inner cable 38 adjacent the closed socket swage 28, and a second tie wrap 44 secures the cover 40 to the inner cable 38 adjacent the open socket swage 30.

Any suitable cover can be used as the covers 22 and 40, as long as it is constructed from a rugged, flexible material that would stand up to the handling and storage requirements of the sling. Additionally, it is beneficial that the cover 22 or 40 be removable so that the wire rope sling 10 or 26 can be tested and inspected during proof load testing, and the cover 22 or 40 can then be readily replaced. The wire slings used to move the various satellite components are annually load tested to insure that they meet the required lifting capabilities, and will not fail when carrying multimillion dollar satellite components. Also, the covers 22 and 40 are easily cleanable using alcohol or some other cleaner.

One known commercially available product that satisfies the particular needs of the covers 22 and 40 described herein, is referred to as Zippertubing, and is available from the ZIPPERTUBING company of Los Angeles, Calif. The ZIPPERTUBING company provides various covers and jackets made of different materials, including polyurethane, teflon, PVC, polyester, etc., and of different sizes. For purposes of the present invention, a VNH material can be used that is a tough abrasion-resistant, medium weight vinyl-coated nylon, and is cost effective. The vinyl-impregnated nylon cloth construction of the VNH material provides high breaking strength. Additionally, the Zippertubing offers various types of zipper connections along the length of the cover 22 to allow the cover 22 to be removed form the sling 10.

Figure 3:
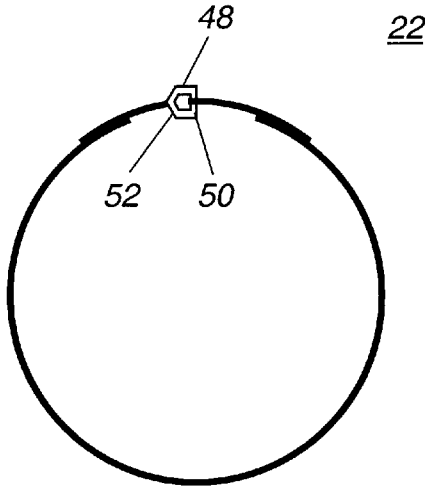
FIG. 3 is a cross-sectional view of a Zippertubing cover used to cover the wire rope sling shown in FIGS. 1 and 2, according to the invention.
Figure 4:
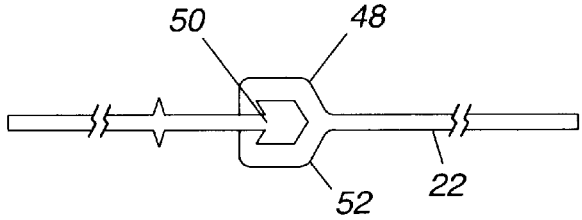
FIG. 4 is a cut-away cross-sectional view of the clasping mechanism of the cover shown in FIG. 3.

FIG. 3 shows a cross-sectional view of the cover 22 removed from the sling 10, and including a standard Z-track connection 48. The Z-track connection 48 includes a male connector 50 and a female connector 52, as shown in FIG. 4, that allows the cover 22 to be wrapped around the sling 10 and secured in place. The male connector 50 is inserted into the female connector 52 in a snap-fit engagement to secure the cover 22 to the sling 10. The Z-track connection 48 allows the cover 22 to be readily removed from the sling 10, and replaced after the sling 10 has been inspected during the load test.

The foregoing discussion discloses and describes merely exemplary embodiments of the present invention. One skilled in the art will readily recognize from such discussion, and from the accompanying drawings and claims, that various, changes, modifications and variations can be made therein without departing from the spirit and scope of the invention as defined in the following claims.

What is claimed is:

1. A cable comprising:

an inner core;

a soft nylon coating enclosing the core; and an outer covering positioned over the coating, said covering including a first end and a second end and being removably secured to the cable; wherein the outer covering is secured to the cable by a first securing device that secures the covering at the first end and a second securing device that secures the covering at the second end.

2. The cable according to claim 1 wherein the outer covering is flexible.

3. The cable according to claim 2 wherein the outer covering is made of a vinyl-impregnated nylon cloth material.

4. The cable according to claim 1 wherein the outer covering includes a zipper-type closure device extending along the length of the covering from the first end to the second end.

5. The cable according to claim 4 wherein the zipper-type closure device is a Z-track closure including a channel portion and a ridge portion, where the ridge portion fits within the channel portion in a snap fit engagement.

6. The cable according to claim 1 wherein the first and second securing devices are tie wraps.

7. The cable according to claim 1 wherein the first and second securing devices are selected from the group consisting of thimbles, eye loops, hooks, shackles, swages, and connectors.

8. The cable according to claim 1 wherein the inner core includes a plurality of intertwined steel strands.

9. A wire rope sling for lifting spacecraft components during assembly of a spacecraft, said sling including a first end and a second end, said sling comprising:

an inner metal core including a plurality of intertwined steel strands;

a nylon coating enclosing the core;

a flexible outer tubing positioned over the nylon coating, said tubing including a first end and a second end, said tubing further including a zipper-type closure device extending from the first end to the second end of the tubing, said zipper-type closure device allowing the tubing to be removably secured to the sling; and a first securing device that secures the first end of the tubing to the sling and a second securing device that secures the second end of the tubing to the sling.

10. The sling according to claim 9 wherein the tubing is made of a vinyl-impregnated nylon cloth material.

11. The sling according to claim 9 wherein the zipper-type closure device is a Z-track including a channel portion and a ridge portion, where the ridge portion fits within the channel portion in a snap fit engagement.

12. The sling according to claim 9 wherein the first and second securing devices are tie wraps.

13. The sling according to claim 9 further comprising a first securing piece attached to the first end of the sling and a second securing piece attached to the second end of the sling, wherein the first and second securing pieces are selected from the group consisting of thimbles, eye loops, hooks, shackles, swages, and connectors.

14. A method of making a cable, comprising:

providing a metal core of intertwined steel strands;

providing a nylon coating over the core; and removably attaching a flexible tube over the nylon coating by separating an opening extending along the length of the tube, and then closing the opening with a zipper-type securing device so that the tube is secured to the cable at a first end of the tube and at a second end of the tube.

15. The method according to claim 14 wherein the tube is made of a vinyl-impregnated nylon cloth material.

16. The method according to claim 15 wherein tie wraps are used to secure the tube to the cable at the first and second ends of the tube.

17. The method according to claim 14 wherein the zipper-type securing device is a Z-track including a channel portion and a ridge portion, where the ridge portion fits within the channel portion in a snap fit engagement.

* * * * *